United States Patent [19]

Schmidt et al.

[11] Patent Number: 4,998,994

[45] Date of Patent: Mar. 12, 1991

[54] AERODYNAMICALLY COMPLIANT PROJECTILE NOSE

[75] Inventors: Edward M. Schmidt, Forest Hill; William F. Donovan, Aberdeen, both of Md.

[73] Assignee: The United States of America as represented by the Secretary of the Army, Washington, D.C.

[21] Appl. No.: 409,900

[22] Filed: Sep. 20, 1989

[51] Int. Cl.[5] ..... F42B 15/027

[52] U.S. Cl. ..... 244/3.1; 89/18.11

[58] Field of Search ..... 244/3.1; 89/1.811, 1.817

[56] References Cited

U.S. PATENT DOCUMENTS

| | | | |
|---|---|---|---|
| 2,594,766 | 4/1952 | Goddard | 244/75 R |
| 3,069,112 | 12/1962 | Patterson | 244/3.19 |
| 3,262,655 | 7/1966 | Gillespie, Jr. | 244/172 |
| 3,444,779 | 5/1969 | Buell et al. | 89/1.811 |
| 4,579,298 | 4/1986 | Thomson | 244/3.21 |
| 4,756,492 | 7/1988 | Kranz | 244/3.1 |

*Primary Examiner*—Charles T. Jordan
*Assistant Examiner*—Rochelle Weberman
*Attorney, Agent, or Firm*—Saul Elbaum; Paul S. Clohan

[57] ABSTRACT

A high velocity aerodynamic projectile having a central body with a forward end, a rearward end and a longitudinal axis, the forward end of the body has a pedestal coaxially extending outward from the body. The projectile has aft stabilizing fins or a flare rigidly affixed at its rearward end and a forward stablizing means pivotably attached to the pedestal of the central body. The forward stabilizing means consists of a self-aligning projectile nose having its rearward end separated from the forward end of the projectile's central body so as to allow the self-aligning projectile nose to pivot and align with the oncoming air stream.

12 Claims, 5 Drawing Sheets

AERODYNAMICALLY COMPLIANT PROJECTILE NOSE

RIGHTS OF THE GOVERNMENT

The invention described herein may be manufactured, used and licensed by or for the United States Government for Governmental purposes without payment to us of any royalty thereon.

BACKGROUND OF THE INVENTION

The present invention relates to high velocity aerodynamic projectiles, especially projectiles flying at supersonic velocities.

Classical ballistic projectile design is usually divided according to the type of stabilization provided for the projectile. In general, there are three types of stabilization designs: spin stabilization, flare stabilization and fin stabilization. With spin stabilization, the projectile is maintained in axial alignment with the air stream by a continuous hunting correction due to a gyroscopic moment acting around the center of gravity (CG) of the rotating mass. Fin stabilization employs essentially plane face aerodynamic lifting surfaces attached to the aft end of a low spin projectile to provide a transverse correcting moment around the CG of the projectile to counter the lifting force developed by the forward nose section, which is usually conical or ogive in shape, as the projectile drifts from axial alignment with the air stream. The flare stabilized projectile substitutes the favorable symmetrical pressure distribution around an aft flare for a fin to achieve the same effect. In all three cases, the disturbing moment is due to the lifting forces on the nose and varies with the angle of attack of the air stream on the nose element.

OBJECTS AND SUMMARY OF THE INVENTION

It is therefore the primary object of this invention to improve the flight characteristics and the accuracy of the fin and flare stabilized projectiles by reducing or eliminating the effect of the disturbing force traceable to the nose lift.

The above and other objects of the invention are achieved by a high velocity aerodynamic projectile, particularly a projectile flying at supersonic velocity, having a means for stabilizing the aerodynamic projectile body. The stabilizing means is located in the nose section of the projectile whereby a means is provided for the nose section to swivel during flight and self-align with the air stream thus reducing the magnitude of the displacing force acting upon the nose section and therefore reducing the upsetting moment acting on the projectile.

DETAILED DESCRIPTION OF THE PREFERRED EMBODIMENTS

Figure 1:
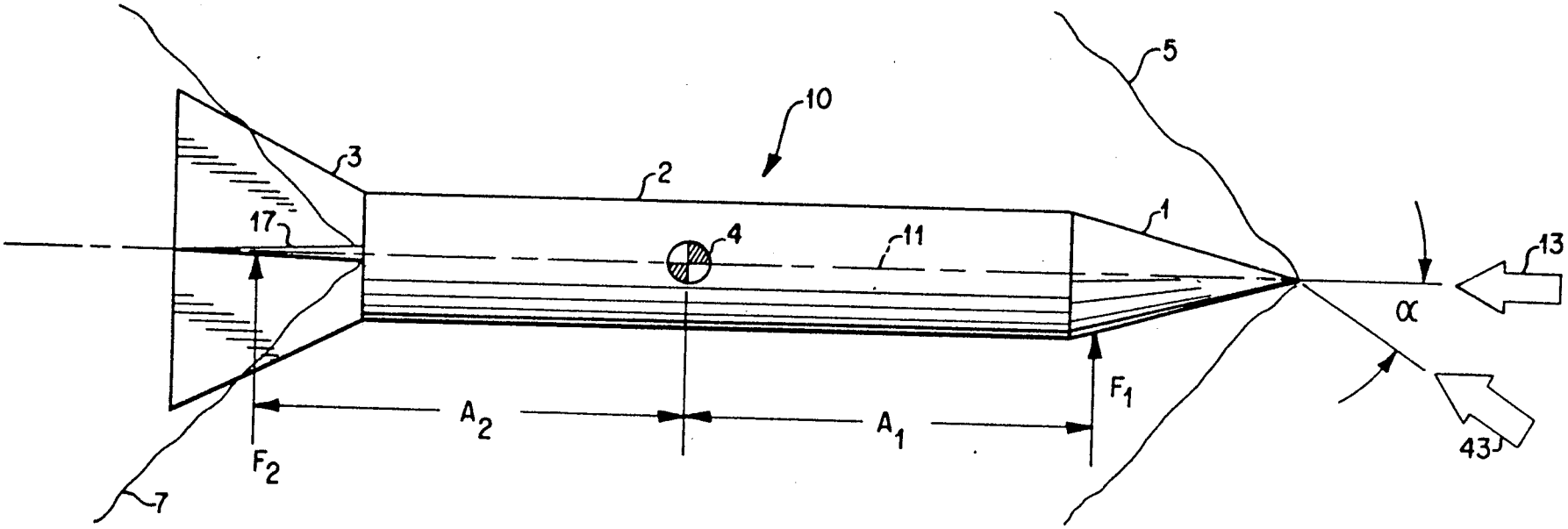
FIG. 1 is a front view of a typical rigid nose, fin stabilized projectile in axial free flight.

Referring now to FIG. 1 a typical fin stabilized projectile 10 in axial free flight is shown after having been accelerated to supersonic velocity by a launcher (not shown). Rigid nose 1 may be conical or ogive of any power law geometric description and is firmly affixed or contiguous with body 2. Body 2 is usually cylindrical and may or may not have driving grooves. Body 2 may be completely monolithic or of grafted element construction. An aft stabilizing means such as fins 3 or an equivalent flare is firmly affixed to body 2 by interference fit, threadably attached, or otherwise mechanically coupled.

The net CG 4 of projectile 10 is the fulcrum about which the aerodynamic fluid forces act. In stable flight, the transverse fluid forces on the projectile are those generated by the nose shock wave 5 pressure field acting on its respective surface area resulting in a lifting force $F_1$, and the fin shock wave 7 pressure field acting on the transverse fin area resulting in aft force $F_2$. The net moment about CG 4 is the algebraic sum of force $F_1$ times its moment arm $A_1$ and force $F_2$ times its moment arm $A_2$. If this sum is zero, then the projectile is neutrally stable. If aerodynamic stability is to be assured, then force $F_1$ will be symmetrically conical and therefore force $F_1$ will be zero since the pressure is uniformly distributed about the nose. Force $F_2$ will also be zero since there will be no angle of attach of the fin blade and therefore no pressure difference over the fin surface. This is the condition where the longitudinal axis 11 of projectile 10 is coaxial with the trajectory path of CG 4 and relative wind 13.

As the trajectory of projectile 10 changes during flight, the projectile's longitudinal axis 11 will have an angle of attack $\alpha$ with respect to the direction of the relative wind 43 thereby producing an asymmetric distribution of pressure around rigid nose 1 which results in a non-zero force $F_1$ acting to rotate projectile 10 about CG 4. The inclination of fin blade 17 into the air stream produces an opposing and correcting force $F_2$. If the sum of the moments ($F_1A_1$ and $F_2A_2$) is favorable, the longitudinal axis 11 of projectile 10 will realign with relative wind 43.

Figure 2:
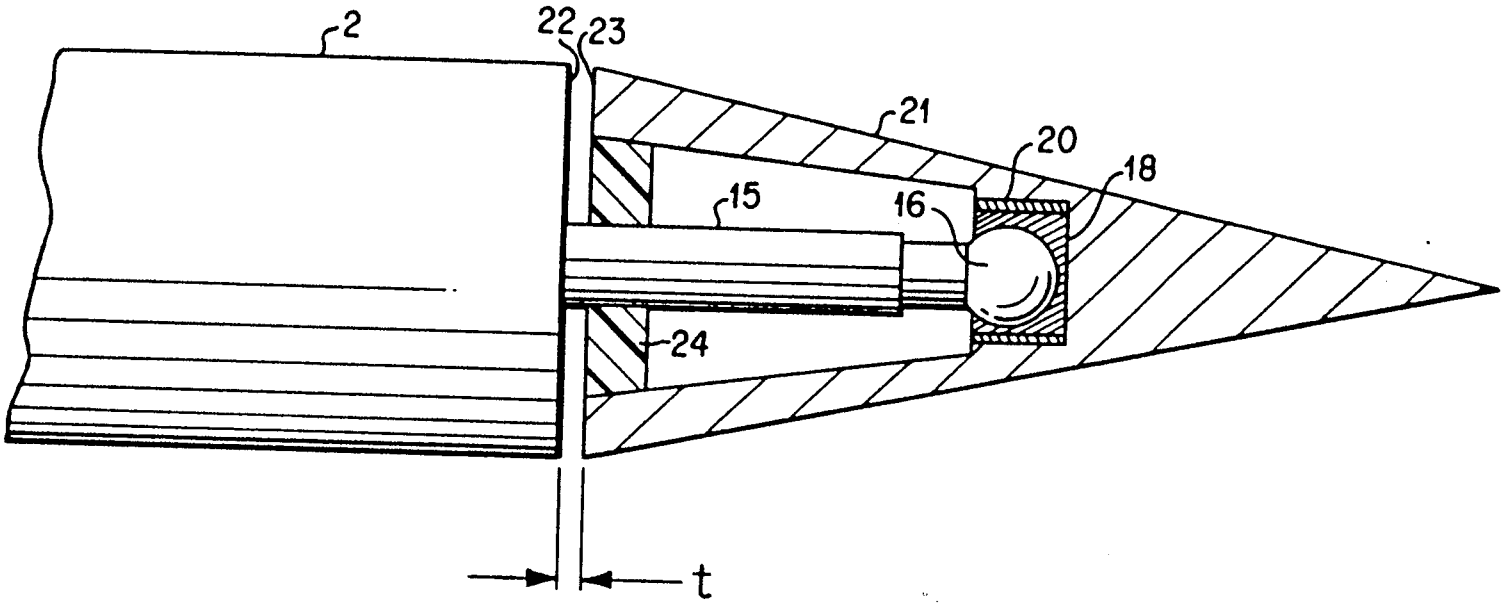
FIG. 2 is a partial cross section of an aerodynamically compliant projectile nose according to the present invention.

FIG. 2 shows the mechanical elements of a self-aligning projectile nose 21 of conical or ogive shape according to the teachings of the present invention. A pedestal 15 with integral spherical segment bearing 16 is rigidly affixed to the forward end 22 of body 2. Spherical bearing 16 is housed in bushing 18 having a spherical seat in contact with spherical bearing 16. Bushing 18 is confined by sleeve 20 which will be pressed or shrunk fit into nose 21 after assembly to bushing 18 and bearing 16. A close fit "t", anywhere from 0.005" to 0.010", is maintained between rearward end 23 of self-aligning nose 21 and forward end 22 of body 2. The swivel range of self-aligning nose 21 about bearing 16 is limited only by the strength of the neck behind spherical bearing 16 and is typically 5 to 10 degrees off longitudinal axis 11. A soft elastometric sleeve 24 is an optional item and provides initial alignment for the assembly.

Figure 3:
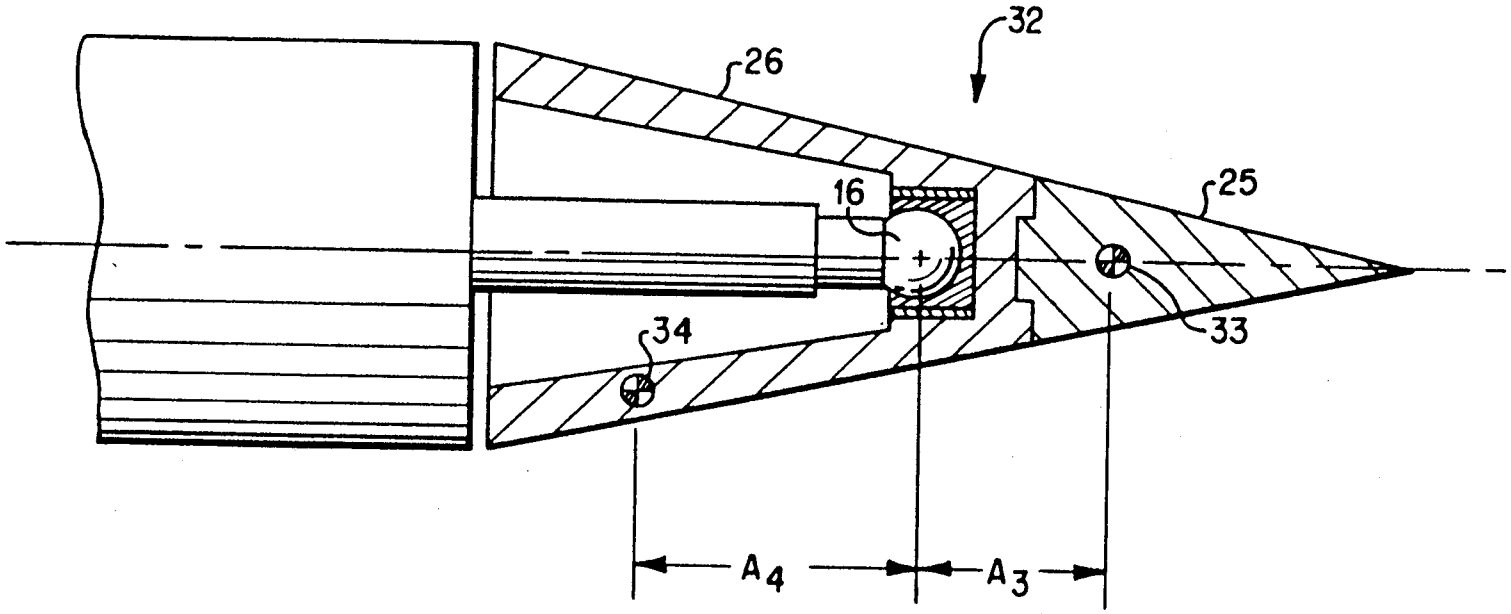
FIG. 3 is a partial cross section of an alternate embodiment of an aerodynamically compliant projectile nose according to the present invention.

FIG. 3 shows an alternate embodiment of a self-aligning nose section. Self-aligning nose 32, again of conical or ogive shape, is now constructed as a two piece element consisting of forward nose section 25 and aft nose section 26 which are rigidly attached together. In this embodiment, the mass balance about spherical bearing 16 is designed to be zero. The mass of forward nose section 25 multiplied by the distance $A_3$ of its CG 33 from the pivot point of spherical bearing 16 is equal to the mass of aft nose section 26 multiplied by the distance $A_4$ of its CG 34 to the pivot point of sperical bearing 16. When these two moments are equal, there will be no unbalanced rotational forces around the pivot point of spherical bearing 16.

The typical launch environment of a high velocity projectile is severe in most gun applications, but relatively benign in a free missile. For gun launch, longitudinal acceleration of many tens of thousands of g's and lateral accelerations of a few thousand g's are typical. The longitudinal loading can be supported either through proper design of pedestal 15 and spherical bearing 16 or by transfer of load to the projectile at the interface of surface 22 and 23. Lateral loads can be survived through proper structural design and support provided by pedestal 15, bearing 16 and elastometric sleeve 24. Vibration of the nose with respect to the body, both in-bore and in-flight, is controlled by proper selection of the elastometric sleeve 24 or by elimination of unbalanced inertial loads. Lubrication of bearing 16 can be accomplished with conventional wet or dry lubricants or with the use of ram air bled in from a central hole in the nose apex.

Figure 4:
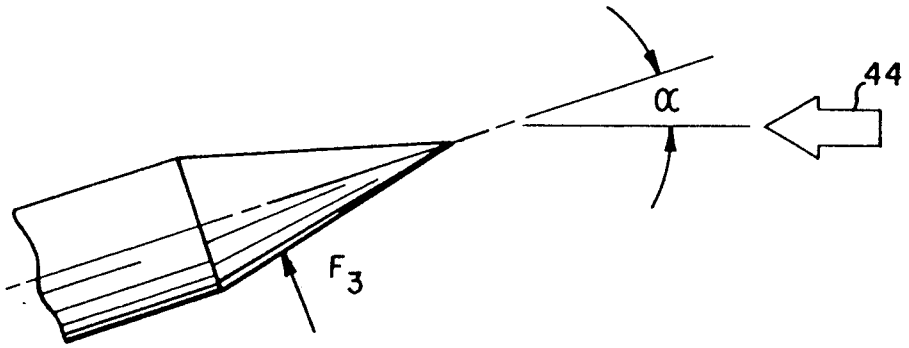
FIG. 4 is a depiction of the transverse aerodynamic force acting on a rigid projectile nose.
Figure 5:
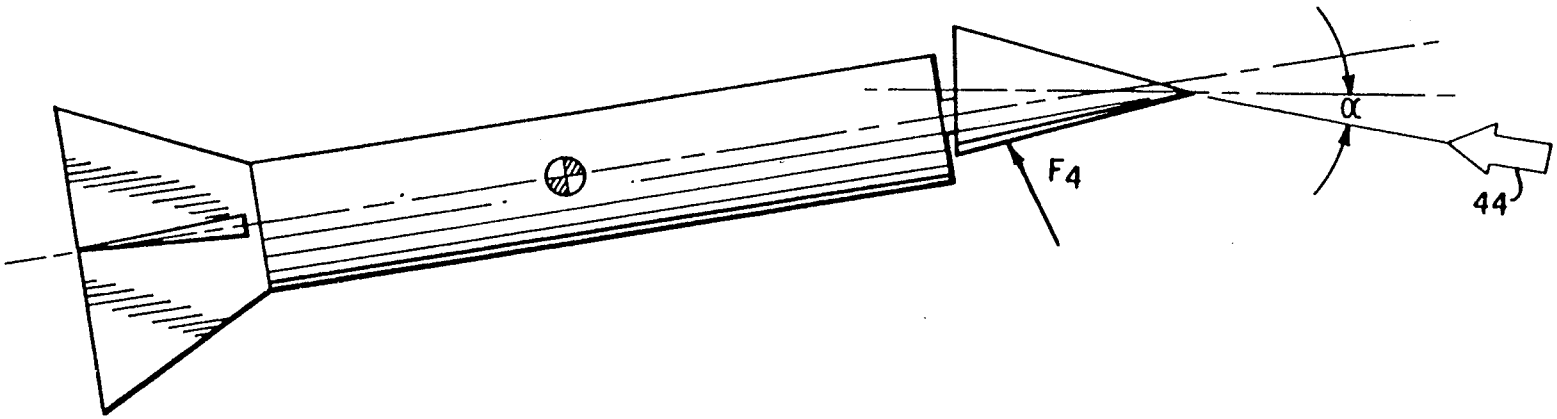
FIG. 5 shows the comparable transverse aerodynamic force on an aerodynamically compliant projectile nose according to the present invention.
Figure 6:
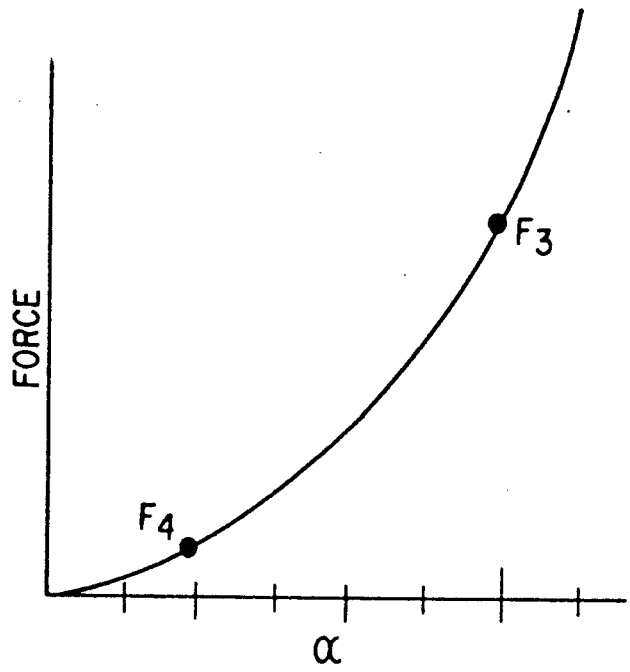
FIG. 6 is a graph of the transverse aerodynamic force acting on both a rigid and compliant projectile nose vs angle of attack.

In order to understand how the aerodynamically compliant projectile nose aids in the stability of the projectile, one must consider the forces acting on the nose of a projectile during flight. FIG. 4 shows a transverse aerodynamic force $F_3$ acting on a rigid projectile nose at an angle of attack $\alpha$ with respect to the oncoming air stream 44. FIG. 5 shows a comparable transverse aerodynamic force $F_4$ on a self-aligning nose at an angle of attack $\alpha$ with respect to the oncoming air stream 44. FIG. 6 is a plot of both the $F_3$ normal force and the $F_4$ normal force vs the angle of attack $\alpha$ for a typical projectile flight. As can be seen from the graph, the effect of the self-aligning nose is to reduce the magnitude of the displacing force and therefore the upsetting moment acting on the projectile.

To those skilled in the art, many modifications and variations of the present invention are possible in light of the above teachings. It is therefore to be understood that the present invention can be practiced otherwise than as specifically described herein and still will be within the spirit and scope of the appended claims.

We claim:

1. A high velocity aerodynamic projectile subject to a displacing aerodynamic force during flight comprising:

a solid central body having a forward end, a rearward end and a longitudinal axis, said forward end having a single arm pedestal rigidly attached, said pedestal coaxial with said longitudinal axis and extending outward from said solid central body;

an aft stabilizing means rigidly affixed at the rearward end of said solid central body;

a forward stabilizing means pivotably attached to said pedestal of said solid central body, said pedestal extending into the interior of said forward stabilizing means;

said forward stabilizing means comprising a hollow self-aligning projectile nose having a tapering front end and a rearward end separated from said forward end of said solid central body so as to allow said hollow self-aligning projectile nose to pivot and thereby reduce said displacing aerodynamic force.

2. The device of claim 1 further comprising a nose alignment means disposed within said self-aligning projectile nose, said nose alignment means comprising an elastometric sleeve affixed to said pedestal and flush with said rearward end of said projectile nose.

3. The device of claim 1 wherein said projectile nose is conical in shape.

4. The device of claim 1 wherein said projectile nose is ogive in shape.

5. The device of claim 1 wherein said aft stabilizing means is a plurality of aerodynamic fins.

6. The device of claim 1 wherein said aft stabilizing means is a flare.

7. A high velocity aerodynamic projectile subject to a displacing aerodynamic force during flight comprising:

a solid central body having a forward end, a rearward end and a longitudinal axis, said forward end having a single arm pedestal rigidly attached, said pedestal coaxial with said longitudinal axis and extending outward from said solid central body, said pedestal having a spherical bearing affixed at its outward end;

an aft stabilizing means rigidly affixed at the rearward end of said solid central body;

a forward stabilizing means pivotably attached to said spherical bearing of said pedestal of said solid central body, said pedestal extending into the interior of said forward stabilizing means;

said forward stabilizing means comprising a hollow self-aligning projectile nose having a tapering forward nose section in balance about said spherical bearing with a tapering aft nose section and a rearward end separated a distance between 0.005" to 0.010" from said forward end of said solid central body so as to allow said hollow self-aligning projectile nose to pivot and thereby reduce said displacing aerodynamic force.

8. The device of claim 7 further comprising a nose alignment means disposed within said self-aligning projectile nose, said nose alignment means comprising an elastometric sleeve affixed to said pedestal and flush with said rearward end of said projectile nose.

9. The device of claim 7 wherein said projectile nose is conical in shape.

10. The device of claim 7 wherein said projectile nose is ogive in shape.

11. The device of claim 7 wherein said aft stabilizing means is a plurality of aerodynamic fins.

12. The device of claim 7 wherein said aft stabilizing means is a flare.

* * * * *